US005346024A

United States Patent [19]

Geiger et al.

[11] Patent Number: 5,346,024

[45] Date of Patent: Sep. 13, 1994

[54] TOOL CONSTRUCTION

[75] Inventors: Robert E. Geiger; John M. Clapp, both of Sayre, Pa.

[73] Assignee: Ingersoll-Rand Company, Woodcliff Lake, N.J.

[21] Appl. No.: 214,501

[22] Filed: Mar. 18, 1994

Related U.S. Application Data

[63] Continuation of Ser. No. 66,637, May 26, 1993, abandoned, which is a continuation of Ser. No. 902,176, Jun. 22, 1992, abandoned.

[51] Int. Cl.[5] ..... F01C 21/10

[52] U.S. Cl. ..... 173/221; 418/270

[58] Field of Search ..... 418/70, 103, 186, 270; 173/93, 93.5, 218, 220, 104, 109, 221; 81/467, 470

[56] References Cited

U.S. PATENT DOCUMENTS

| | | | |
|---|---|---|---|
| 1,832,123 | 11/1931 | Holland . | |
| 2,174,314 | 9/1939 | De Mooy | 173/93.5 |
| 2,246,648 | 6/1941 | Van Sittert et al. | 192/30.5 |
| 2,261,204 | 11/1941 | Awtsberg | 173/93.5 X |
| 2,947,282 | 8/1960 | Roggenburk | 173/93.5 X |
| 3,015,244 | 1/1962 | Newman | 81/52.3 |
| 3,129,796 | 4/1964 | Karden et al. | 192/30.5 |
| 3,174,606 | 3/1965 | Hornschuch et al. | 173/93 X |
| 3,257,877 | 6/1966 | Ulrich et al. | 173/216 X |
| 3,318,390 | 5/1967 | Hoza et al. | 173/12 |
| 3,557,884 | 1/1971 | Allen | 173/93.5 |
| 3,988,076 | 10/1976 | Wolf et al. | 418/270 X |
| 4,553,948 | 11/1985 | Tatsuno | 464/25 |
| 5,017,109 | 5/1991 | Albert et al. | 418/270 X |

*Primary Examiner*—Rinaldi I. Rada
*Attorney, Agent, or Firm*—Walter C. Vliet

[57] ABSTRACT

A power tool construction wherein an integrated pressure fluid motor is provided with a unitary motor cylinder and back head and an external cooperative porting surface for cooperation with a valve porting surface. A further feature of the construction provides a cooperating front head plate with concentric alignment lands for attachment of the motor and a power output device such as a gear reducer.

7 Claims, 2 Drawing Sheets

TOOL CONSTRUCTION

This application is a continuation of application Ser. No. 08/066,637, filed 05/26/93, which is a continuation of application Ser. No. 07/902,176, filed on 06/22/92, both abandoned.

BACKGROUND OF THE INVENTION

This invention relates generally to construction features for power tools and more particularly to an integrated motor cylinder, back plate and controller for control of pressure to a pneumatically operated hand held power tool.

In the past, construction of pressure fluid driven power tools has been accomplished by assembly of individual components requiring assembly time and critical alignment. In addition, tolerances and stress have served to distort the assembled units.

The foregoing illustrates limitations known to exist in present construction for power tools. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a power tool construction comprising a motor having unitary motor cylinder and back head provided with an external valve porting surface for cooperation with a valve means for selectively admitting motive media to the motor.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
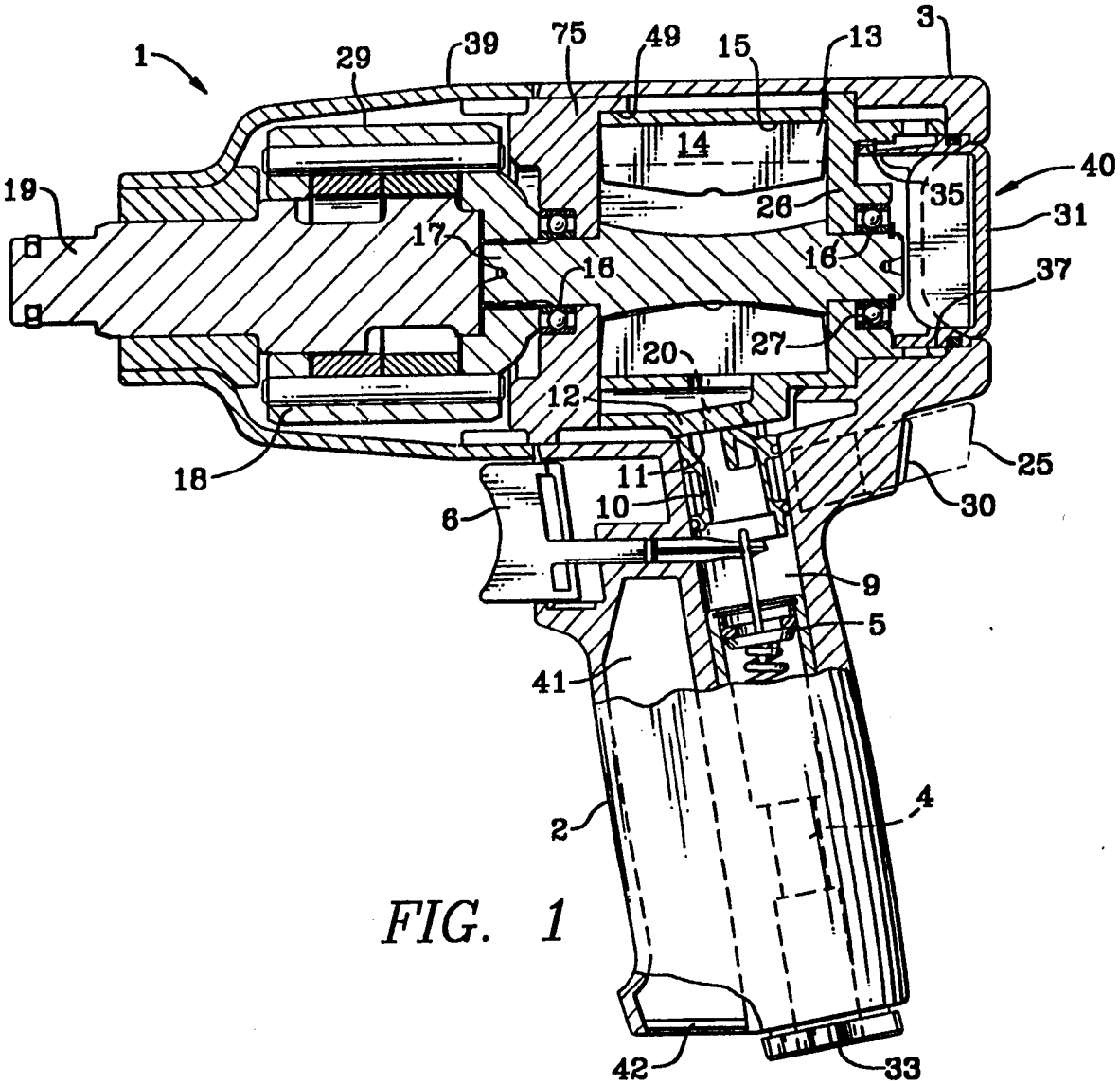
FIG. 1 is a sectional side elevation view of a power regulated power tool according to the present invention.

Referring to FIG. 1, an impact wrench power tool 1 is shown in section. The power tool 1 is provided with a handle 2 having a pneumatic fluid or air inlet 33 for providing motive fluid to a pneumatic operated motor or air motor 13. Air is supplied to the air motor through air inlet passageway 4. A tilt valve 5 is operated by means of a trigger 6 to admit pressure fluid to a chamber 9.

Figure 2:
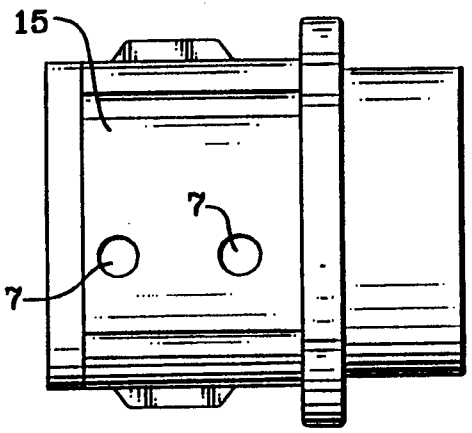
FIG. 2 is a top view showing the integrated cylinder back plate and controller cavity construction according to the present invention.
Figure 3:
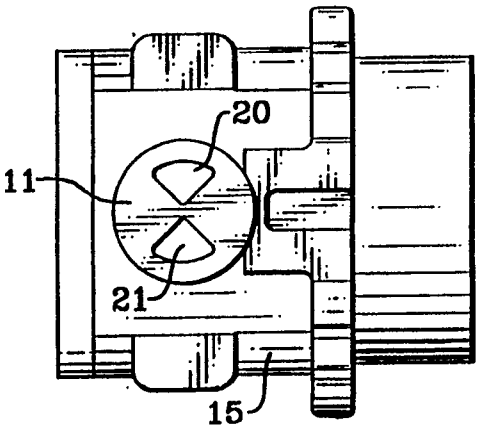
FIG. 3 is a bottom view of the integrated cylinder construction according to the present invention showing the cooperating valve surface.

Disposed within chamber 9 is a rotary spool element 10 performing as a reversing valve means for selectively distributing pressure fluid to a forward supply port 20 or optionally a reverse port 21 (shown on FIG. 3) hidden behind the forward port 20 at a position approximately opposite the forward port in the planer plate 12.

The reversing valve spool 10 is provided with a planer segmented end 11 which slidingly cooperates with the planer surface of the plate 12.

Air entering the forward or reverse ports 20 or 21 selectively proceeds to drive the air motor 13 in forward or reverse direction as the air is expanded against motor vanes 14 in the motor cylinder 15. The motor rotates on bearings 16 and 16 to drive an output shaft 17. The output shaft 17 drives a work output device such as a rotating frame 18 of an impact clutching device which through the clutch drives a square drive work output device 19. Alternatively, the output shaft 17 may drive an alternative work output device such as a gear reducer or the like.

It should be appreciated by one skilled in the art that rotating the reversing valve spool 10 approximately 90 degrees by depressing either the forward pushbutton 30 or the reverse pushbutton 25 will align the spool passageway with one or the other ports 20 or 21 leading to either the forward or reverse chambers of the motor.

Rotating the reversing valve spool 10 will therefore accomplish direction of flow of motive fluid to either forward or reverse drive the motor.

Expanded air exhausts the motor via exhaust passageway or ports 7 which eventually exits through the handle exhaust passageway 41 and exhaust screen or muffler 42 to atmosphere.

Referring to FIG. 1, a bypass power regulator 40 is shown installed at the back end of the power tool in line with the motor. The regulator may be described as an irregular cylinder closed at one end having a knob 31 formed on the closed end to facilitate its rotation about its cylindrical axis in tool bore 37.

The periphery of the regulator 40 towards the open end is provided with a series of power regulating steps. These steps cooperate with the forward pressure fluid supply port to permit a greater or lesser degree of pressure fluid to bypass the motor from essentially zero to a maximum.

Figure 5:
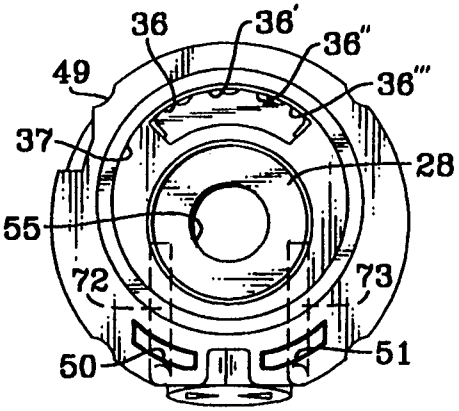
FIG. 5 is a rear end view of the integrated cylinder construction.

The regulator cylinder is also provided with an axially extending indexing finger 35 which cooperates with a series of indexing indentations 36, 36', 36'', and 36''', formed in the rear of the tool housing, as best seen in form FIG. 5.

As previously stated, the bypass regulator 40 is installed in a cylindrical bore 37 and is free to rotate therein. The rotary position of the bypass regulator may be selected by turning knob 31 to the desired position to obtain the degree of power output required. The selected position is retained by the index finger 35 cooperating with the index positioning grooves 36 et seq. as previously described.

It should be understood by one skilled in the art that the porting provided in the casing of the power tool utilizes formed interspaced channels within the housing and are difficult to depict in planar presentation. However, for purpose of describing the present invention, it is sufficient to understand that cooperating fluid flow channels are provided in the tool casing 3 to effect the supply of pressure fluid to the motor in the forward direction and the reverse direction and to permit both the primary and second exhaust of pressure fluid from the tool.

The present invention is directed particularly towards the construction of the air motor and the associated reversing valve planer surfaces. According to the present invention, an apparatus is disclosed which provides superior construction and valving characteristics.

According to the present invention, the motor cylinder 15, back head 26, the cylindrical bore 37 for the power regulator, and a bore 27 for the rear bearing 16', are provided in an integral one piece structure as depicted in FIGS. 2–8. In addition, a number of internal distribution ports are provided in the integral structure, for example, inlet forward and reverse ports 20 and 21, respectively, are provided in valve plate 12, as previously described. These ports cooperate and provide pressure fluid to forward inlet passageway 50 and reverse inlet passageway 51. The inlet passageways 50 and 51 communicate respectively with forward supply slot 60 and reverse slot 61 provided in the interior cylinder wall 45.

Figure 6:
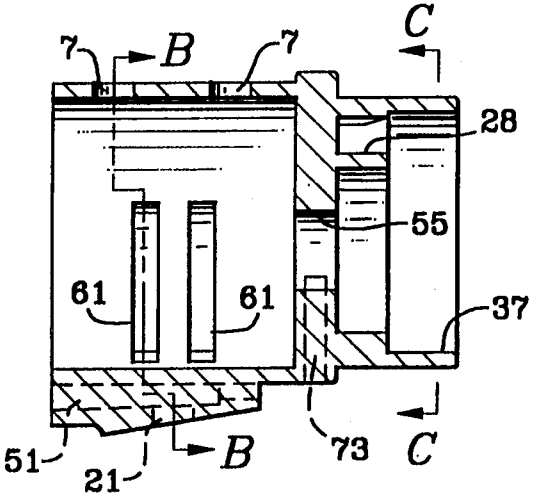
FIG. 6 is a cross section view of the integrated cylinder according to the present invention taken at Section A—A of FIG. 4.
Figure 4:
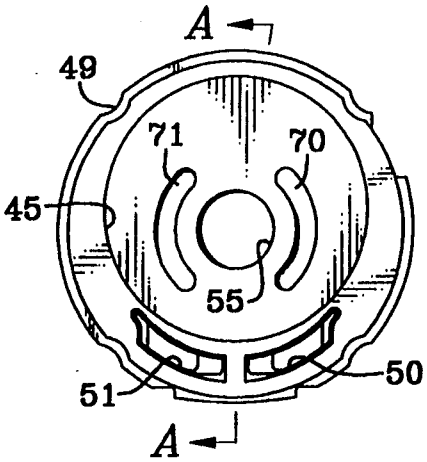
FIG. 4 is a front end elevation view of the integrated cylinder construction according to the present invention.
Figure 8:
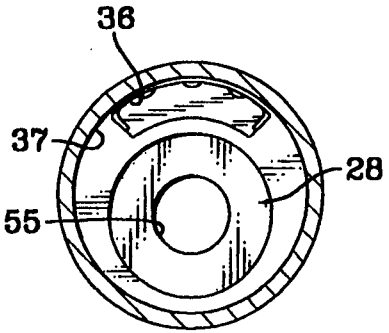
FIG. 8 is a cross section view taken at Section C—C of FIG. 6.
Figure 7:
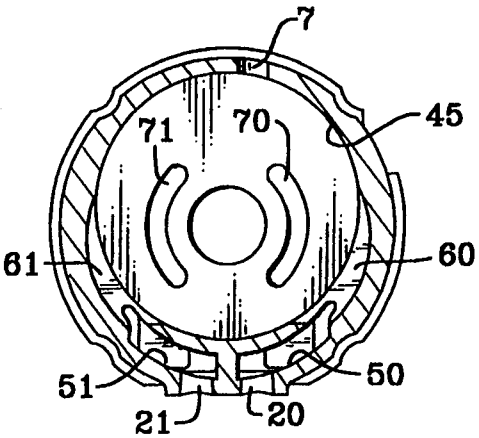
FIG. 7 is a cross section view of the integrated cylinder taken at Section B—B of FIG. 6.

The back plate 26 is further provided with a pair of semi-circular ports, best seen in FIGS. 4 and 6, which communicate with the vane slots of the air motor 13 to assist the blades 14 outward during forward and reverse operation respectively. Drilled cross ports 72 and 73 are provided in the end plate 26 to communicate between the inlet passageways 50 and 51 and the semi-circular ports 70 and 71, respectively, as best seen in dotted lines on FIG. 5.

A bore 55 is provided in the end plate 26 to permit the output shaft 17 to pass through the end plate for support in the bearing 16' which in turn is supported in a bearing boss 28 which extends from the back plate 26, as best seen in FIGS. 5 and 6.

To complete the motor assembly, the cylinder assembly previously described cooperates with a centralizing bore 49 in the forward end plate and forward bearing retainer 75, as best seen in FIG. 1. As may further be appreciated by one skilled in the art, the forward end plate 75 forms a convenient device for the concentric assembly of the impact clutching device 29 and its casing 39. The casing 39 also forms the nose of the power tool.

The construction herein described provides for a convenient and economical method of power tool assembly and further includes a novel valve planer plate surface for the cooperation of a spool type supply. Valve construction features of the present invention permit ready assembly and alignment of the critical parts. The assembly may be readily bolted together by means of axially extending tie bolts. Four notches 49 are shown provided in the peripheral surface of the cylinder and forward end plate 75 of the present invention for purpose of receiving the axially extending tie bolts and for radially positioning the cylinder assembly relative to the housing 3 and the front plate 75.

Having described the invention, what is claimed is:

1. A motor driven power tool construction, comprising:

a motor having unitary one piece motor cylinder and back head provided with an external circumferential planer face valve porting surface in contact with a movable planar face valve for selectively admitting motive media to said motor cylinder.

2. A motor driven power tool construction according to claim 1, wherein said unitary one piece motor cylinder and back head further includes a bearing in said back head.

3. A motor driven power tool construction according to claim 2, wherein said unitary one piece motor cylinder and back head construction further includes a circumferential front plate mating surface on said unitary structure.

4. A motor driven power tool according to claim 3, comprising in combination a front end plate and said front end plate is further provided with a bearing mounting means for mounting a front bearing.

5. A motor driven power tool according to claim 4, wherein said front bearing and said rear bearing mounted in said unitary one piece construction provides support and alignment for a motor rotor.

6. A motor driven power tool construction according to claim 1, wherein said unitary one piece motor cylinder and back head construction further includes a selective power control for the motor power in said back head.

7. A motor driven power tool construction according to claim 1, wherein said unitary one piece motor cylinder and back head construction further includes internal distribution passageways for pressure fluid.

* * * * *